US009010255B2

(12) United States Patent
Baltz

(10) Patent No.: US 9,010,255 B2
(45) Date of Patent: Apr. 21, 2015

(54) KEG PALLET

(71) Applicant: Rehrig Pacific Company, Los Angeles, CA (US)

(72) Inventor: Kyle L. Baltz, Rossmoor, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/758,847

(22) Filed: Feb. 4, 2013

(65) Prior Publication Data

US 2013/0206043 A1 Aug. 15, 2013

Related U.S. Application Data

(60) Provisional application No. 61/594,238, filed on Feb. 2, 2012.

(51) Int. Cl.
*B65D 19/44* (2006.01)
*B65D 19/00* (2006.01)

(52) U.S. Cl.
CPC .. *B65D 19/0004* (2013.01); *B65D 2519/00273* (2013.01); *B65D 2519/00736* (2013.01); *B65D 19/0038* (2013.01); *B65D 2519/00034* (2013.01); *B65D 2519/00069* (2013.01); *B65D 2519/00288* (2013.01); *B65D 2519/00308* (2013.01); *B65D 2519/00318* (2013.01); *B65D 2519/00363* (2013.01); *B65D 2519/00567* (2013.01); *B65D 2519/00815* (2013.01); *B65D 2519/00965* (2013.01)

(58) Field of Classification Search
CPC ..... B65D 19/0004; B65D 2519/00273; B65D 2519/00736; B65D 19/0006; B65D 19/44; B65D 2519/00034; B65D 2519/00139; B65D 2519/00268
USPC ..... 108/52.1, 53.1, 53.3, 55.3, 55.1, 901, 108/56.1, 57.1, 57.16, 57.25, 57.26, 57.27, 108/57.29, 57.33, 57.13; 206/386, 599, 600
See application file for complete search history.

(56) References Cited

U.S. PATENT DOCUMENTS

| | | | | | |
|---|---|---|---|---|---|
| 3,526,195 | A | | 9/1970 | Maryonovich | |
| 3,563,184 | A | | 2/1971 | Angelbeck, Jr. | |
| 3,628,468 | A | | 12/1971 | Angelbeck, Jr. | |
| 3,636,888 | A | | 1/1972 | Angelbeck, Jr. | |
| 3,948,190 | A | | 4/1976 | Cook, III et al. | |
| 3,993,168 | A | | 11/1976 | Kubick | |
| 3,995,749 | A | | 12/1976 | Haskins | |
| 4,263,855 | A | * | 4/1981 | Lawlor | 108/53.3 |
| 4,397,247 | A | | 8/1983 | Lemelson | |
| 4,480,748 | A | | 11/1984 | Wind | |
| 4,516,677 | A | * | 5/1985 | Rowland et al. | 206/394 |
| 4,699,282 | A | * | 10/1987 | Farrar | 206/459.5 |
| 4,838,419 | A | * | 6/1989 | Weits et al. | 206/386 |
| 4,848,711 | A | | 7/1989 | Mandel | |
| D320,880 | S | * | 10/1991 | Brunin | D34/38 |
| 5,052,307 | A | * | 10/1991 | Morrison | 108/53.1 |
| 5,142,994 | A | * | 9/1992 | Sandberg et al. | 108/53.3 |

(Continued)

FOREIGN PATENT DOCUMENTS

WO 0006458 2/2000

*Primary Examiner* — Janet M Wilkens
(74) *Attorney, Agent, or Firm* — Carlson, Gaskey & Olds

(57) ABSTRACT

A pallet includes a lower structure and an upper structure. The lower structure includes a stringer extending across the lower structure. The stringer includes a corner column portion spaced away from central column portion to define a side opening below a bridge portion.

22 Claims, 15 Drawing Sheets

(56) References Cited

U.S. PATENT DOCUMENTS

| | | | | |
|---|---|---|---|---|
| 5,186,338 | A | 2/1993 | Boutet | |
| 5,360,112 | A | 11/1994 | Beauchamp | |
| 5,527,585 | A | 6/1996 | Needham et al. | |
| 5,606,921 | A | 3/1997 | Elder et al. | |
| 5,755,162 | A | 5/1998 | Knight et al. | |
| 5,769,003 | A | 6/1998 | Rose et al. | |
| D403,830 | S * | 1/1999 | Apps et al. | D34/38 |
| 5,857,416 | A * | 1/1999 | Donnell et al. | 108/55.3 |
| 6,311,628 | B1 * | 11/2001 | Smith et al. | 108/55.1 |
| 2002/0043509 | A1 | 4/2002 | Lajeunesse | |
| 2005/0103236 | A1 * | 5/2005 | Apps | 108/56.3 |
| 2006/0075939 | A1 * | 4/2006 | Shuert | 108/57.25 |
| 2006/0272556 | A1 | 12/2006 | Apps | |
| 2007/0199845 | A1 * | 8/2007 | Hartwall | 206/386 |
| 2009/0145339 | A1 * | 6/2009 | Dubois et al. | 108/56.1 |
| 2010/0236456 | A1 * | 9/2010 | Haaf | 108/57.17 |
| 2012/0255261 | A1 * | 10/2012 | Jositas et al. | 53/447 |

* cited by examiner

KEG PALLET

BACKGROUND

Pallets are often used to transport goods. Pallets may include an upper deck supported above the floor so that the tines of a forklift or pallet lift jack can be inserted below the deck to lift the pallet and goods.

Some pallets are designed specifically for beer kegs. The upper deck may include recesses for receiving the lower end of a beer keg. The lower structure may include recesses for receiving the upper end of a beer keg, such as when the pallet is stacked on another pallet loaded with kegs.

SUMMARY

A pallet includes a lower structure and an upper structure. The lower structure includes a stringer extending across the lower structure. The stringer includes a corner column portion spaced away from central column portion to define a side opening below a bridge portion.

The upper structure including an upper deck and a sleeve portion extending downward from the upper deck. The upper structure is connected to the lower structure with the sleeve portion forming double-walls structure with the corner column portion, the bridge portion and the central column portion. This provides reinforcement around the side opening to withstand impacts from the tines of a forklift or pallet lift jack.

The upper surface of the upper deck may include recesses for receiving the lower ends of kegs. The recesses are each defined between an inner raised portion and outer raised portions. The inner raised portions include a continuous, annular surface for contacting the inner surface of the lower end of the keg.

The lower structure may include a plurality of ribs projecting downward. Annular recesses may be formed in the lower, free ends of the ribs. Upper ends of kegs may be received in the annular recesses of a pallet stacked thereon.

DETAILED DESCRIPTION OF THE PREFERRED EMBODIMENT

Figure 1:
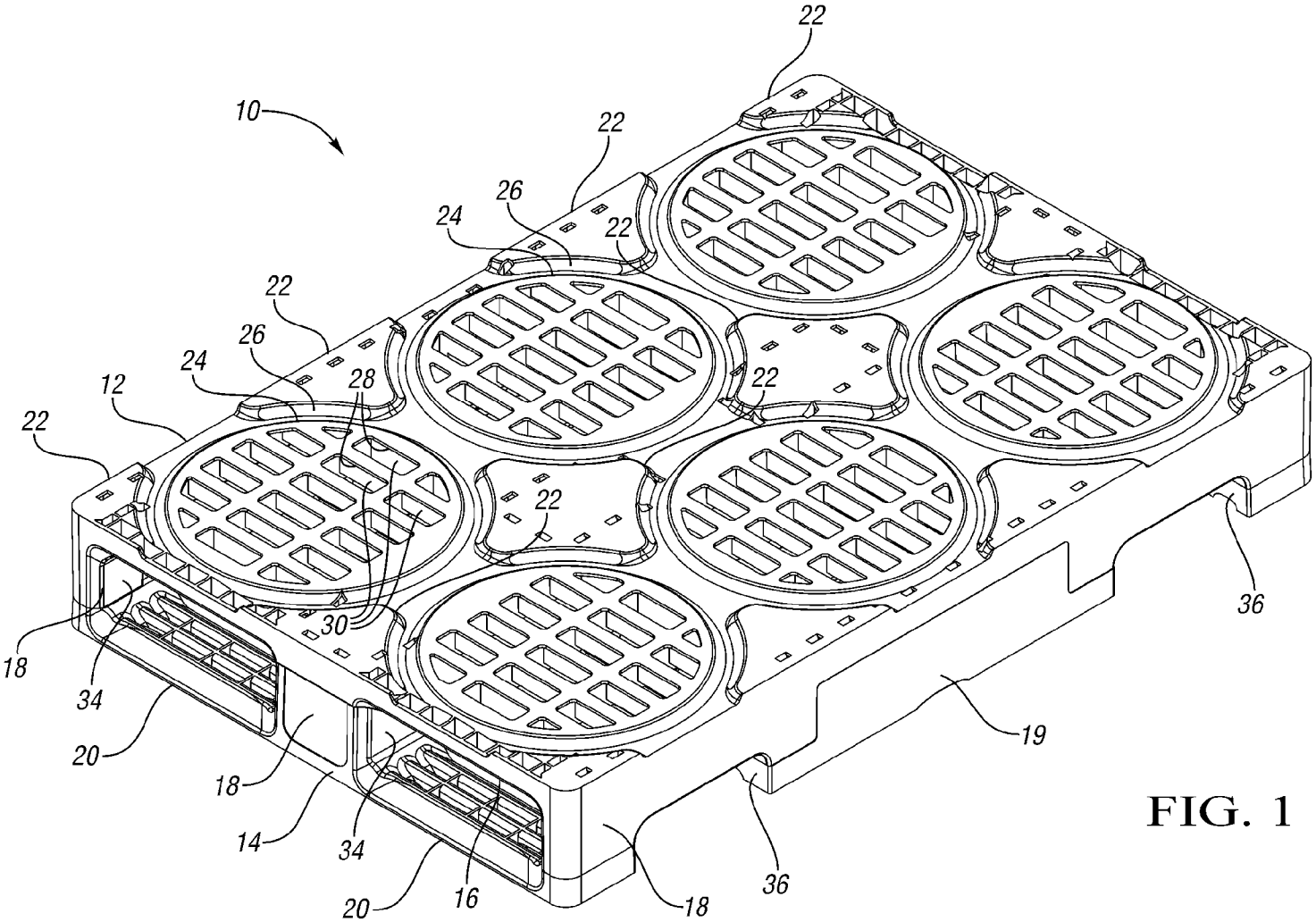
FIG. 1 is an upper perspective view of a pallet according to one embodiment of the present invention.

A pallet 10, adapted particularly for use with kegs, such as beer kegs, is shown in FIG. 1. The pallet 10 is generally formed from two injection molded plastic structures, an upper structure 12 and a lower structure 14. The pallet 10 includes an upper deck 16, which is part of the upper structure 12. A plurality of columns 18 extend below the upper deck 16 and support the upper deck 16. A plurality of runners 20 extend between lower ends of the columns 18.

The upper deck 16 includes an upper surface that is particularly adapted to support beer kegs. The upper deck 16 includes a plurality of raised portions 22 positioned to be around the outer peripheries of the kegs. The upper deck 16 further includes a plurality of inner raised portions 24, which in this example are circular and continuous, arranged to be received within a lower cylindrical end of a beer keg. Annular recesses 26 are defined between the inner raised portions 24 and the raised portions 22. The inner raised portions 24 include a plurality of openings 28 therethrough having ribs 30 extending downwardly therefrom.

The pallet 10 includes end openings 34 defined between the columns 18 and the upper deck 16 and the runners 20. The pallet 10 further includes side openings 36 opening downward between the columns 18 and a central support portion 19 and below the upper deck 16. The openings 34, 36 are for receiving the tines of a fork lift or pallet lift jack.

Figure 2:
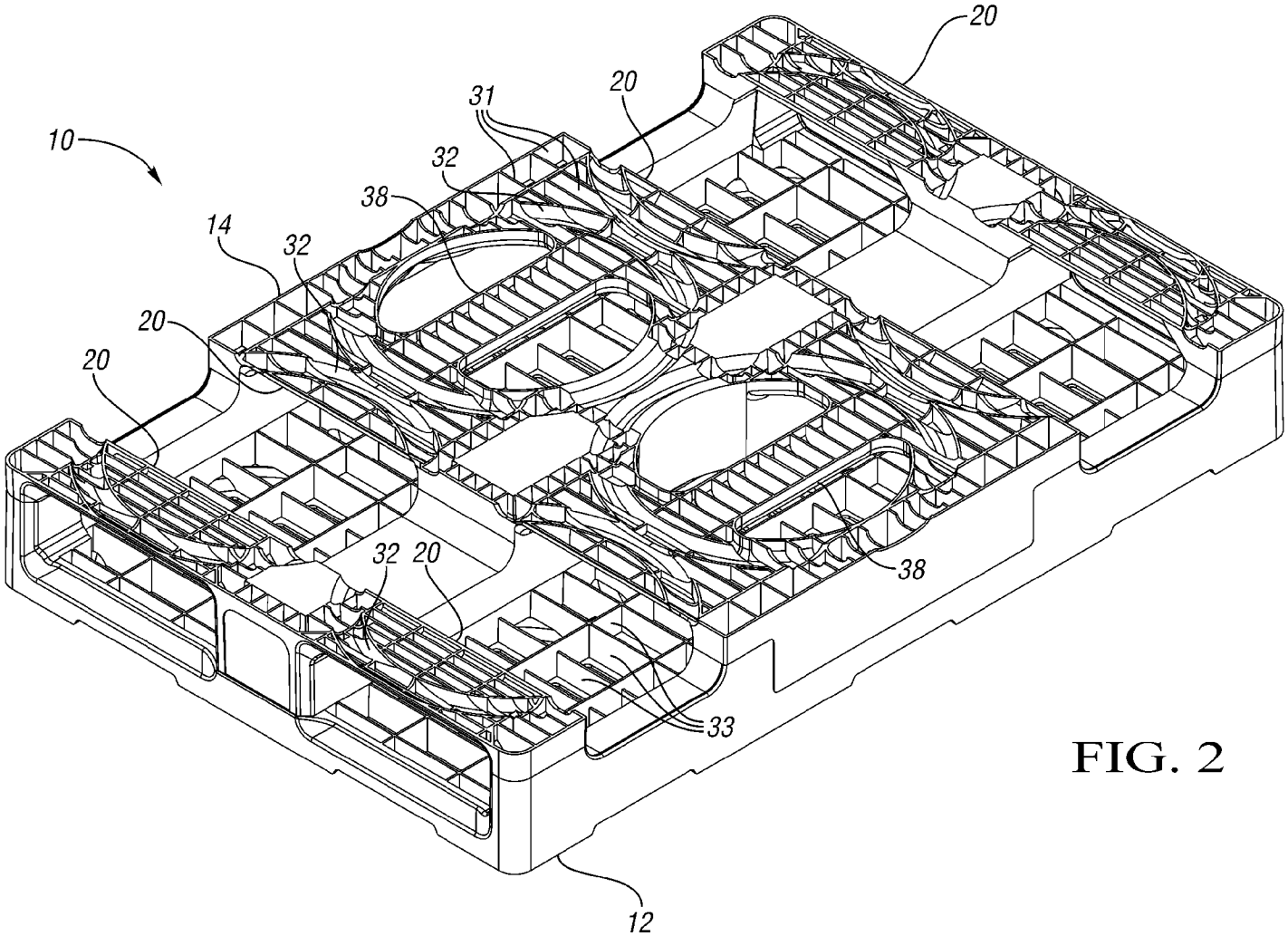
FIG. 2 is a bottom perspective view of the pallet of FIG. 1.

FIG. 2 is a bottom perspective view of the pallet 10. The bottom of the lower structure 14 includes a plurality of ribs 31 extending downwardly from the runners 20. A plurality of annular recesses 32 are formed in the lower, free ends of the ribs 31. The upper deck 16 includes a plurality of ribs 33 projecting downward from an upper sheet portion. Between the center two runners 20 are a pair of circular openings each having a beam 38 extending across it, generally perpendicular to the runners 20.

Figure 3:
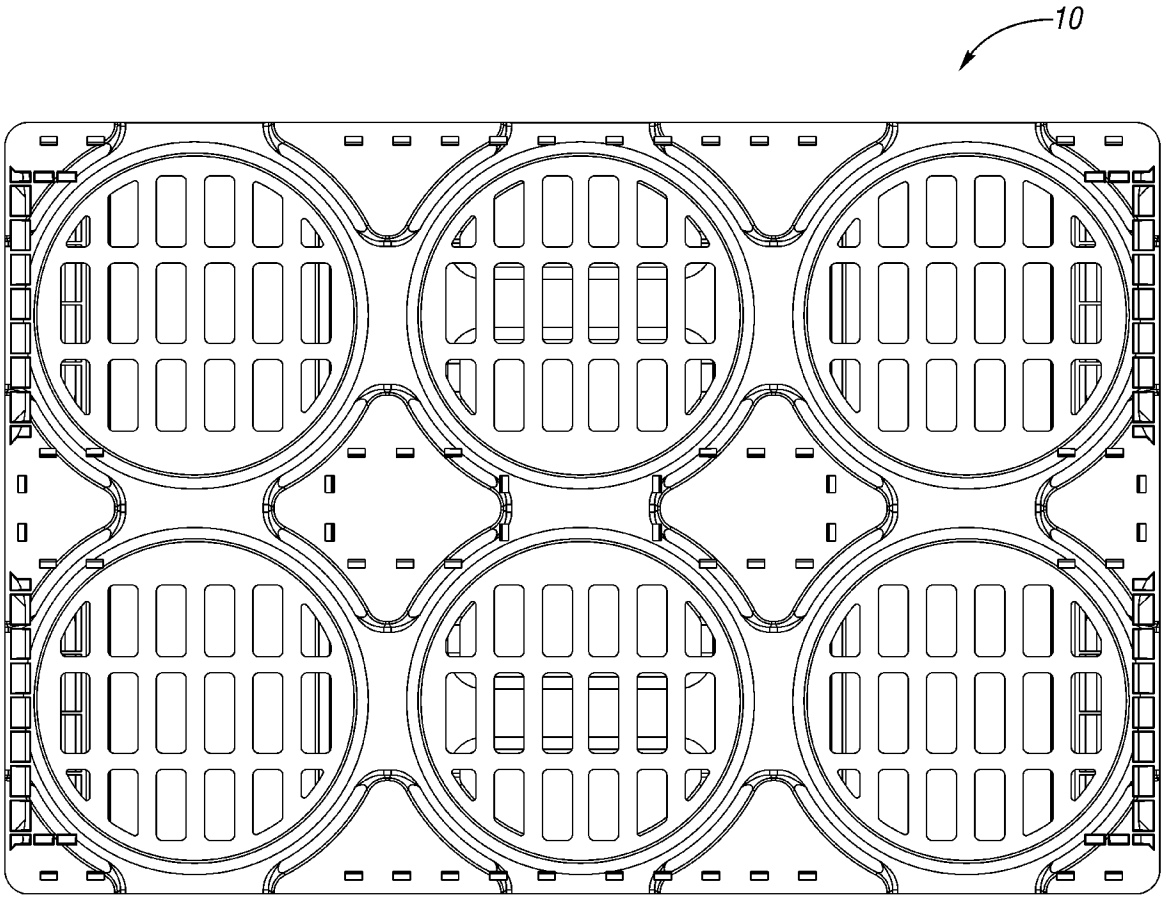
FIG. 3 is a top view of the pallet of FIG. 1.
Figure 4:
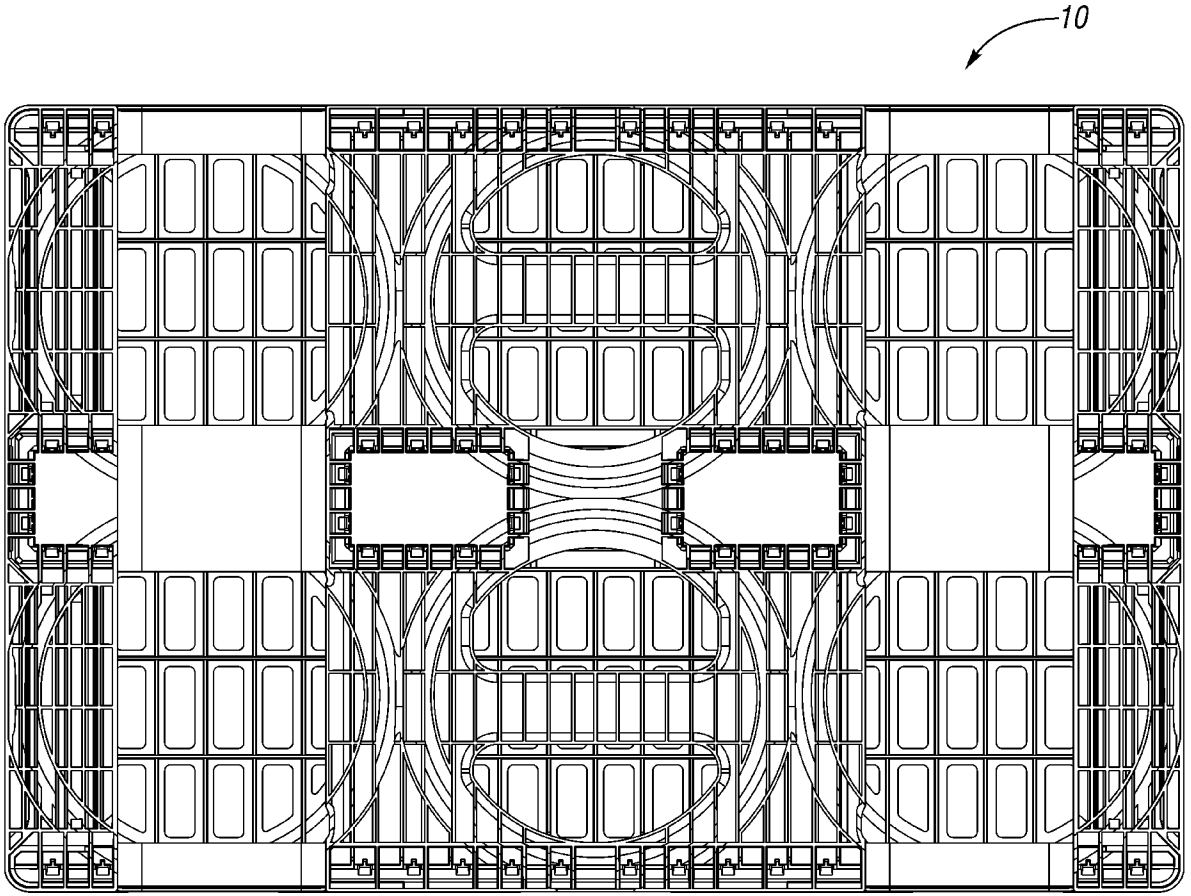
FIG. 4 is a bottom view of the pallet of FIG. 1.
Figure 5:
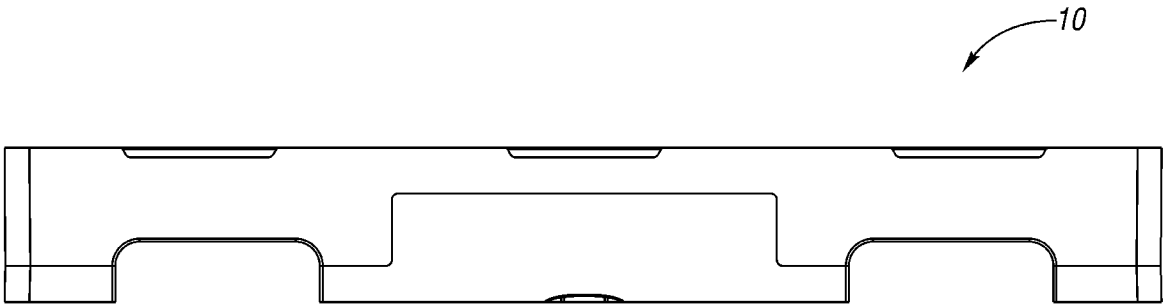
FIG. 5 is a side view of the pallet.
Figure 6:
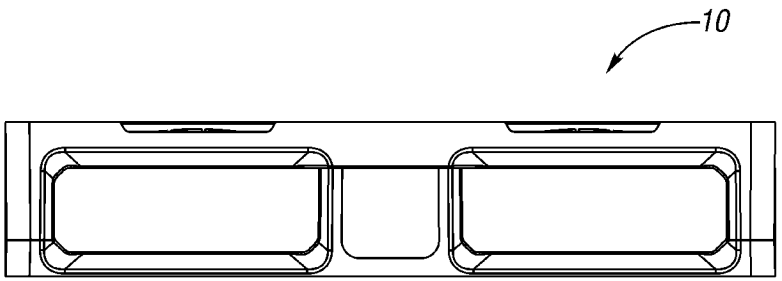
FIG. 6 is an end view of the pallet.

FIG. 3 is a top view of the pallet 10. FIG. 4 is a bottom view of the pallet 10. FIG. 5 is a side view of the pallet 10. FIG. 6 is an end view of the pallet 10.

Figure 7:
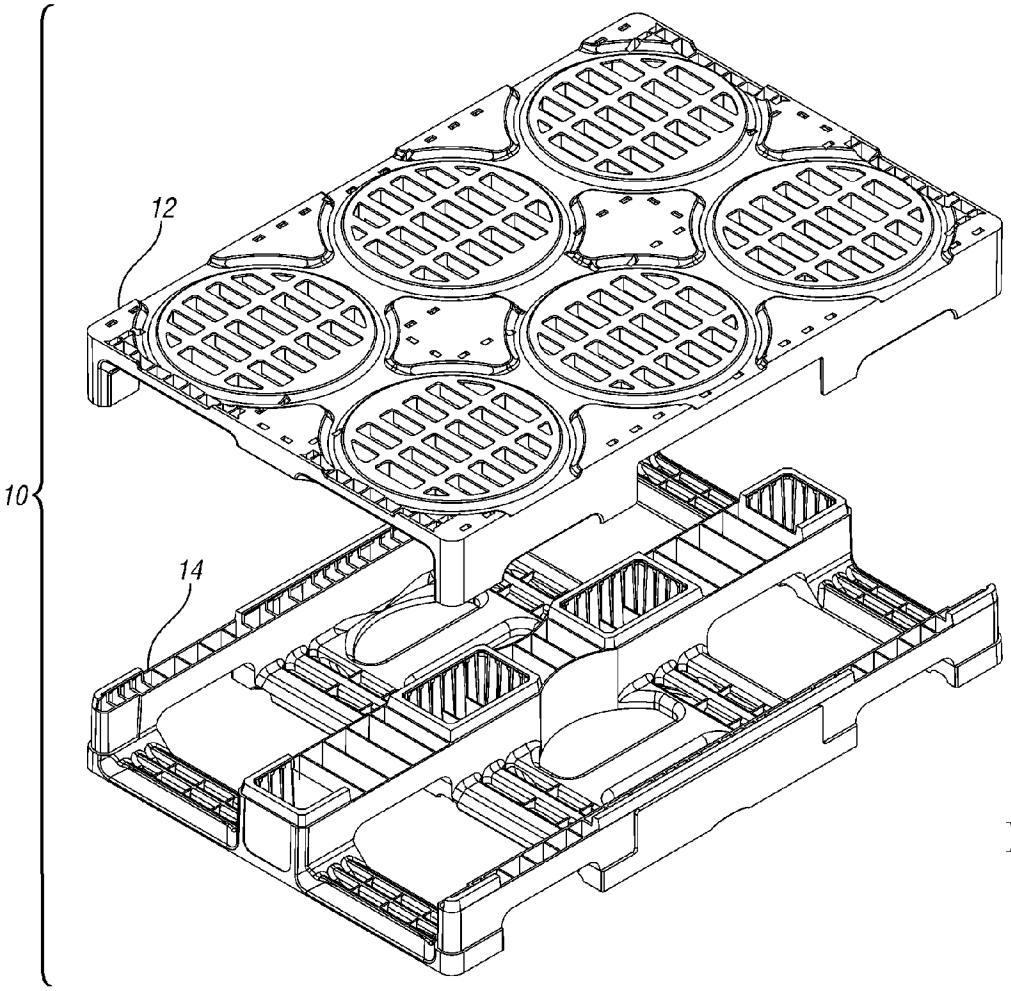
FIG. 7 is an exploded perspective view of the pallet of FIG. 1.

FIG. 7 is an exploded view of the pallet 10, showing the upper structure 12 and lower structure 14. The lower structure 14 and upper structure 12 are described in more detail with respect to FIGS. 8 and 9, respectively.

Figure 8:
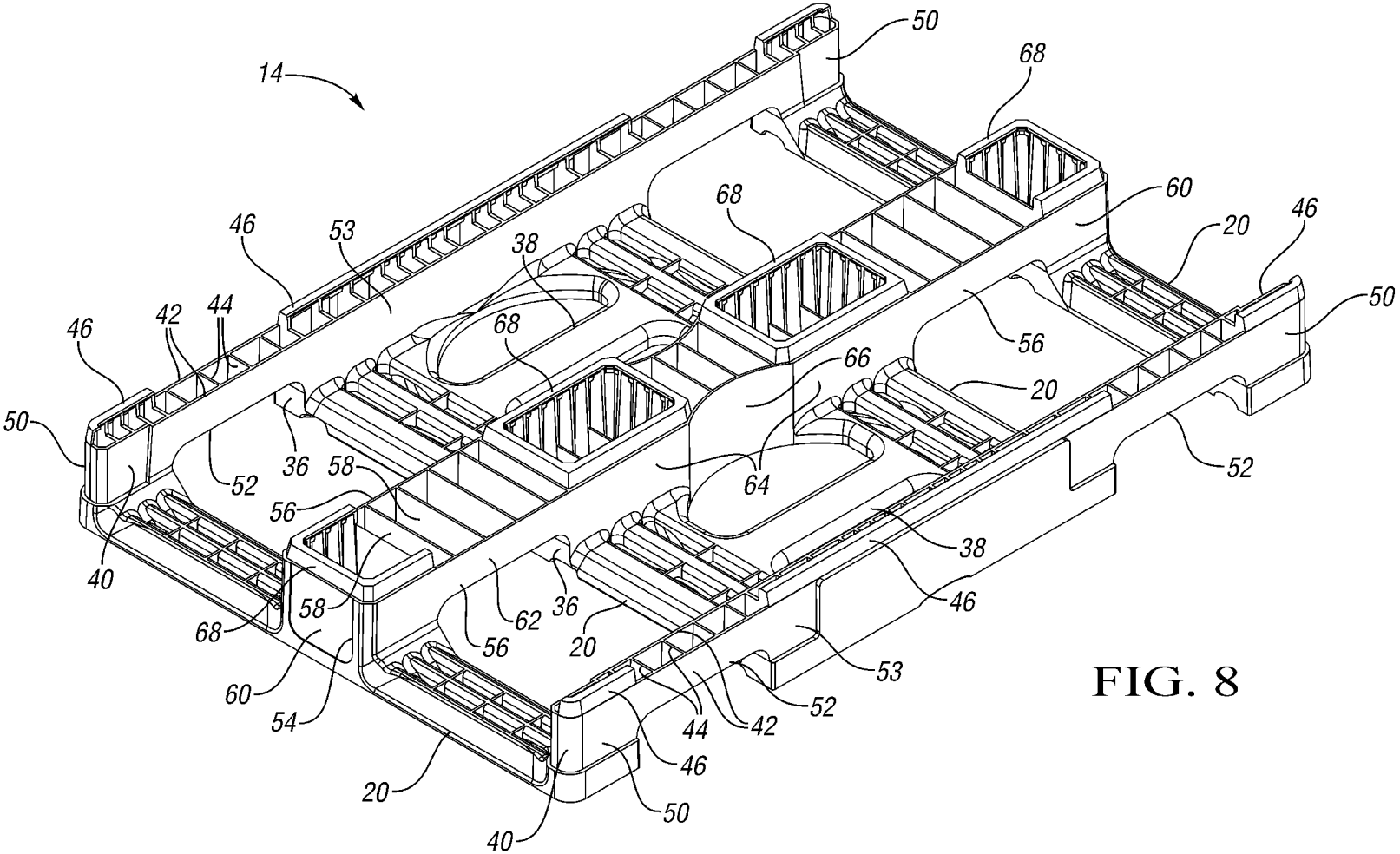
FIG. 8 is a perspective view of the lower structure of the pallet of FIG. 1.

FIG. 8 is a perspective view of the lower structure 14. The lower structure 14 includes a pair of outer stringers 40 extending the length of the lower structure 14 and connecting the runners 20. Each outer stringer 40 includes a pair of spaced apart longitudinal walls 42 connected by perpendicular ribs 44. Connector ribs 46 extend upwardly from the outer wall 42 and then inwardly to form a connector. Each stringer 40 includes a corner column portion 50 at each end. Each outer stringer 40 further includes a bridge portion 52 between the corner column portion 50 and a central column portion or central outer stringer portion 53. The central outer stringer portion 53 connects to the two middle runners 20.

A center stringer 54, more than twice as wide as the outer stringers 40, extends longitudinally along the entire length of the lower structure 14, connecting the runners 20. The beams 38 connect the two inner runners 20 and are generally aligned with the wheels or rollers of a pallet lift jack, such that the wheels or rollers can roll over an outer runner 20 and one of the inner runners 20, then across the beam 38 without having to be rolled up the edge of the second inner runner 20. The cross ribs in the runners 20 are also aligned with the wheels of a pallet lift jack (and the beams 38) to facilitate rolling over the runners 20.

The center stringer 54 includes a pair of spaced apart longitudinal walls 56 connected by perpendicular ribs 58. The center stringer 54 includes a column portion 60 at each end. The center stringer 54 further includes a bridge portion 62 between the column portion 60 and an inner column portion 64. An inner bridge portion 66 connects the two inner column portions 64. Connector ribs 68 protrude upwardly and then inward from each column portion 60, 64 of the center stringer 54 to form connectors.

Figure 9:
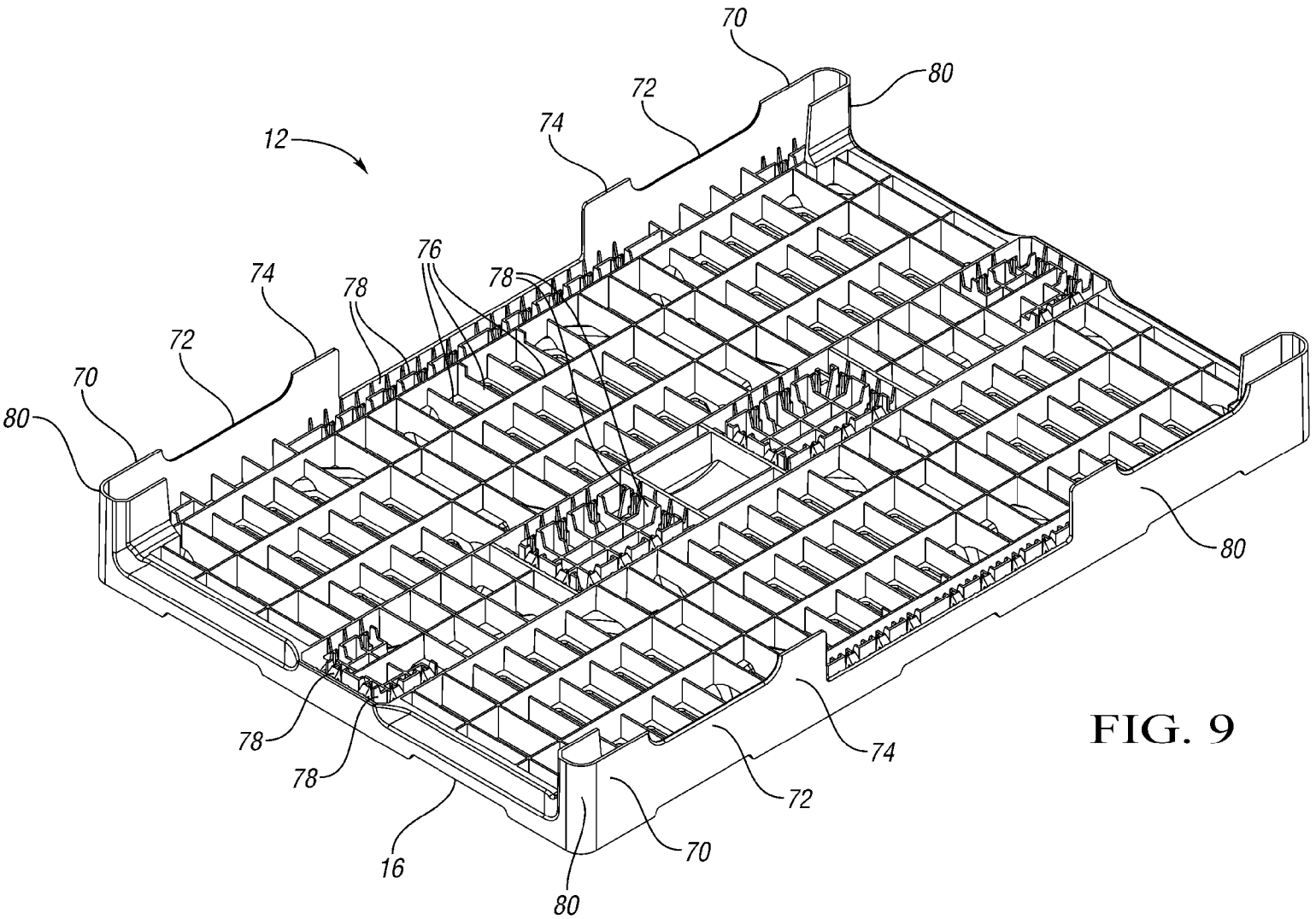
FIG. 9 is a bottom perspective view of the upper structure of the pallet of FIG. 1.

FIG. 9 is a bottom perspective view of the upper structure 12. The upper deck 16 includes a plurality of ribs 76 protruding downwardly. Snap-fit connectors 78, complementary to the connector ribs 46 and 68, also protrude downwardly from the upper deck 16 but are recessed relative to the ribs 76. The snap-fit connector ribs 78 are arranged to align with the connector ribs 46, 68 of the lower structure 14 (FIG. 8). Partial sleeve portions 80 protrude downwardly from the upper deck 16 significantly further than the ribs 76. The partial sleeve portions 80 extend downwardly at each corner of the upper deck 16 and each includes a column portion 70, a bridge portion 72 and a central portion 74. The column portion 70 is arranged to align with the column portions 50 of the stringer 40 of the lower structure 14 (FIG. 8). The bridge portion 72 of the partial sleeve portion 80 is arranged to align with the bridge portion 52 of the outer stringer 40 of the lower structure 14. The central portion 74 is arranged to align with the center stringer 54 of the outer stringer 40 of the lower structure 14 (FIG. 8).

For assembly, the upper structure 12 is snap-fit to the lower structure 14. The sleeve portions 80 of the upper structure 12 provide double-wall thickness reinforcement in the corner areas, including the corner columns 18, of the pallet 10 and provide double-wall thickness reinforcement all around the fork tine openings 36 (FIG. 1) along the long side of the pallet 10. In this particular embodiment, the outer stringers 40 are fairly narrow (approximately 2 inches), so the double-wall thickness portions surrounding the fork tine openings 36 along the long side of the pallet 10 provide reinforcement to the narrow outer stringers 40 against the fork tines contacting the outer stringers 40 when the operator misses the openings 36.

Figure 10:
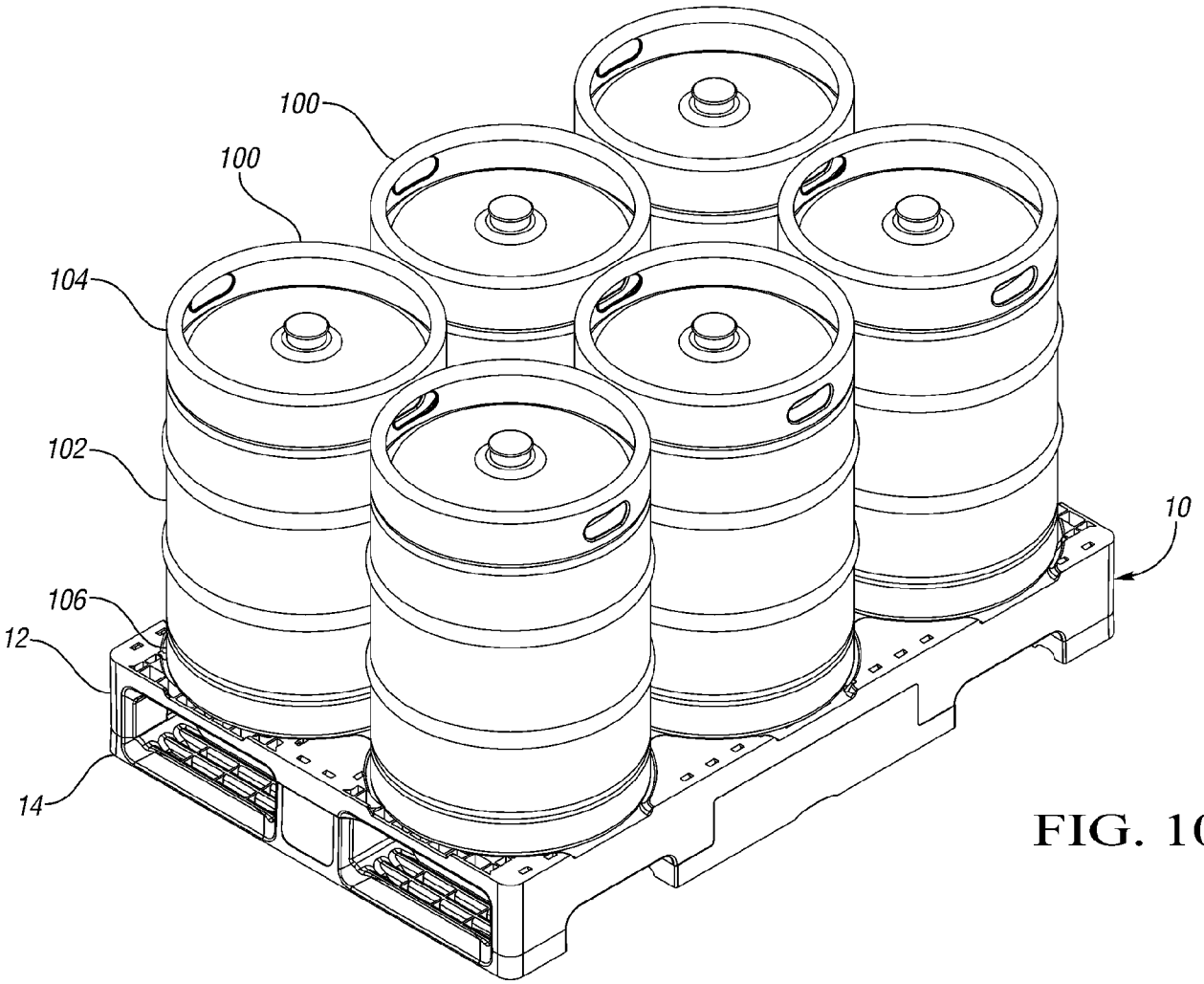
FIG. 10 is a perspective view of the pallet of FIG. 1 loaded with a plurality of kegs.

The assembled pallet 10 is shown in FIG. 10 with a plurality of beer kegs 100 stacked thereon. Each beer keg 100 includes a generally cylindrical body portion, which contains the liquid (e.g., beer). An upper cylindrical portion 104 extends upwardly from the body portion 102 and may contain handles. A lower or base portion 106 extends downward from the body portion 102 and is also generally cylindrical.

Figure 11:
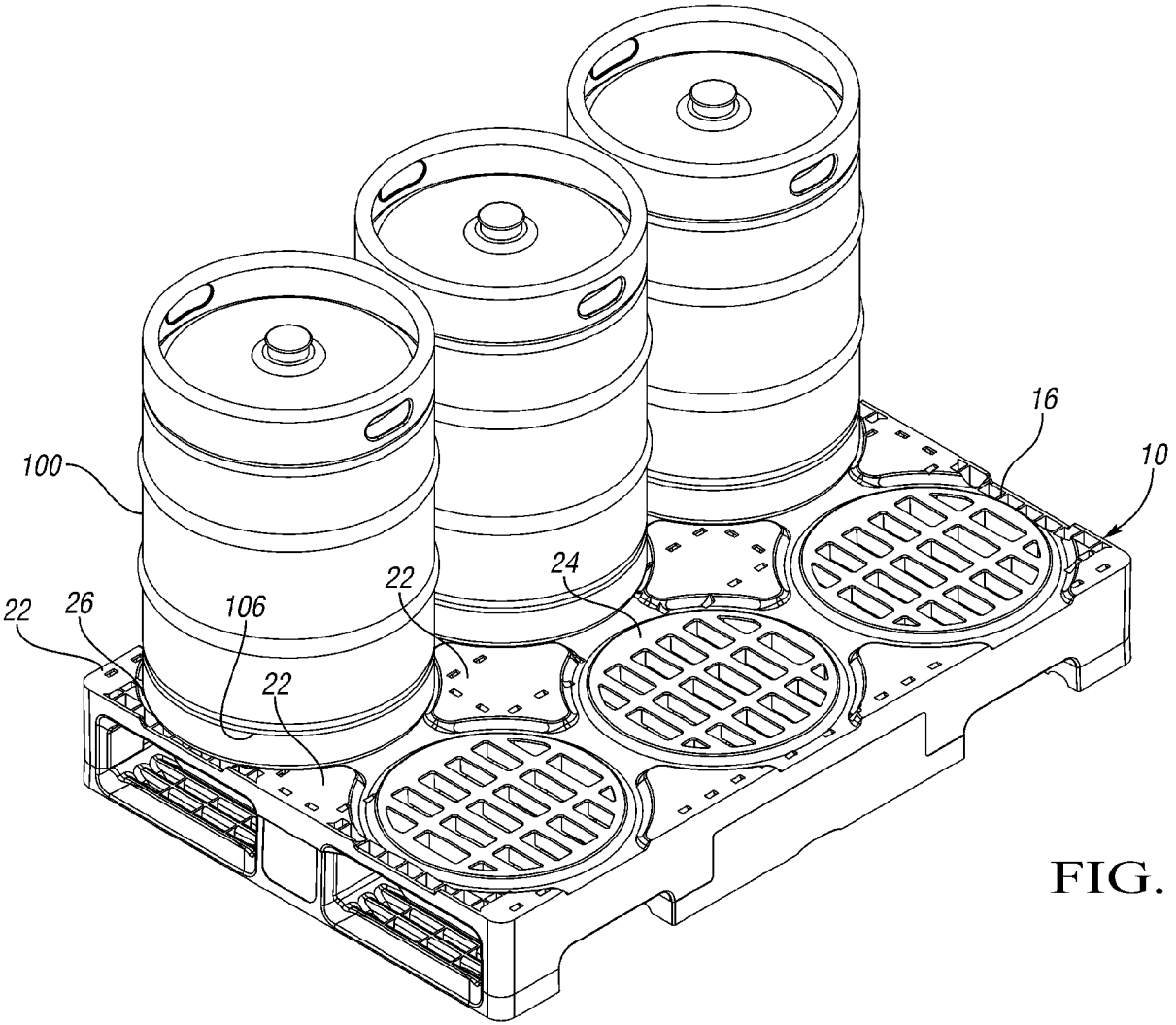
FIG. 11 shows the pallet of FIG. 10 half-loaded with kegs.

FIG. 11 shows the pallet 10 and kegs 100 of FIG. 10 with three kegs removed for illustration. As shown, the base portion 106 of each keg 100 is received in one of the annular recesses 26 in the upper deck 16 of the pallet 10, between the raised portions 22. The inner raised portions 24 of the upper deck 16 are received within the diameter of the base portion 106 of each keg 100.

Figure 12:
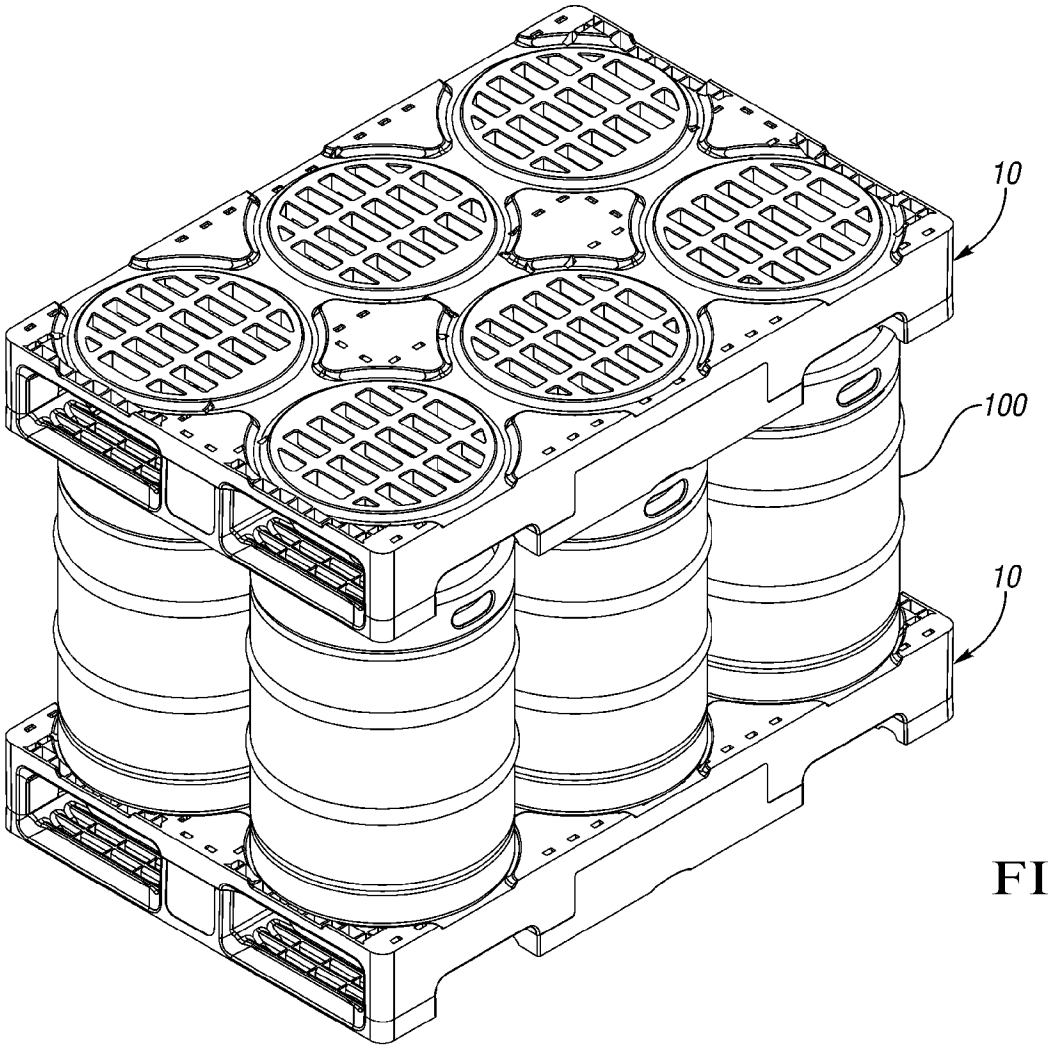
FIG. 12 shows the pallet and kegs of FIG. 11 with an identical pallet loaded thereon.
Figure 13:
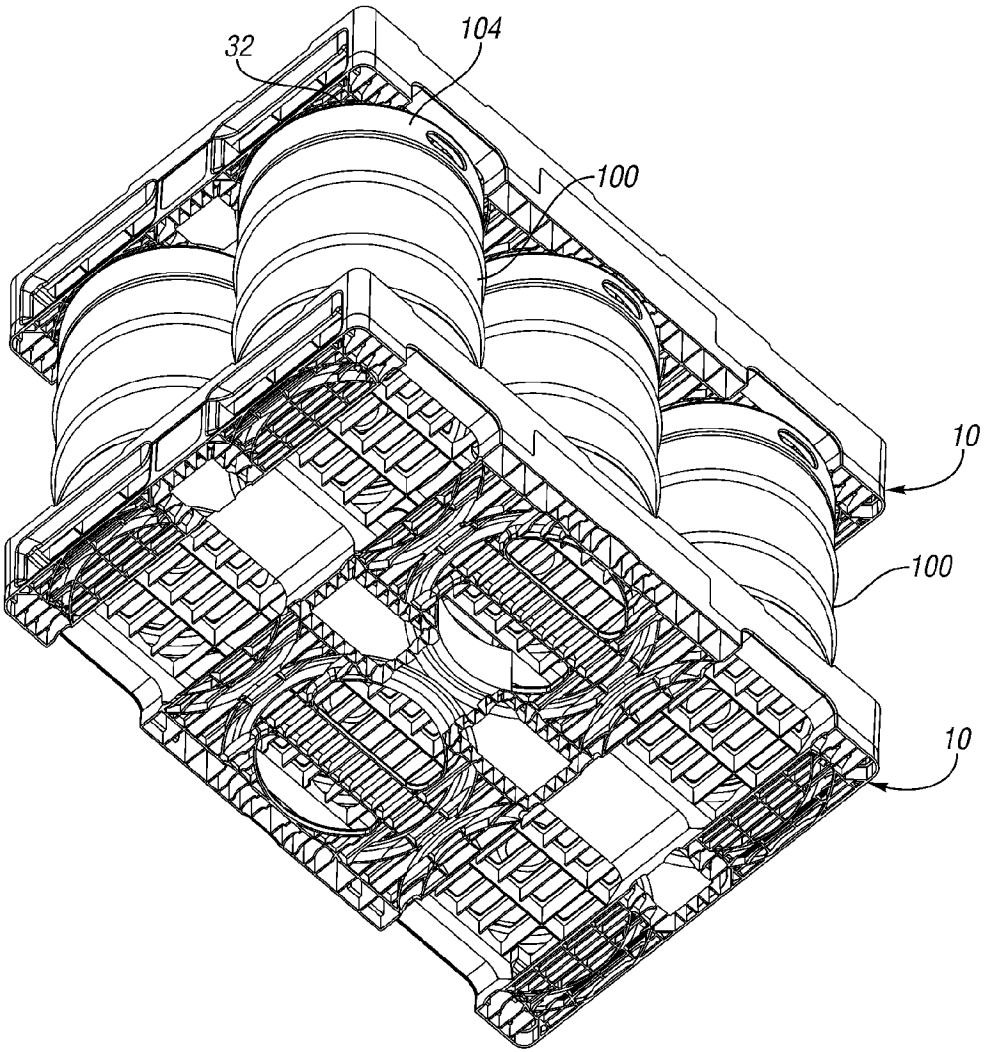
FIG. 13 is a bottom perspective view of the pallets and kegs of FIG. 12.

FIG. 12 shows the pallet 10 and kegs 100 of FIG. 10 with another pallet 10 stacked thereon. As shown in FIG. 13, a bottom perspective view of the kegs 100 and the pallets 10 of FIG. 12, the upper cylindrical portion 104 of each keg 100 is received in the annular recess 32 on the bottom of the upper pallet 10. This provides stable stacking of multiple layers of pallets 10 and kegs 100.

Figure 14:
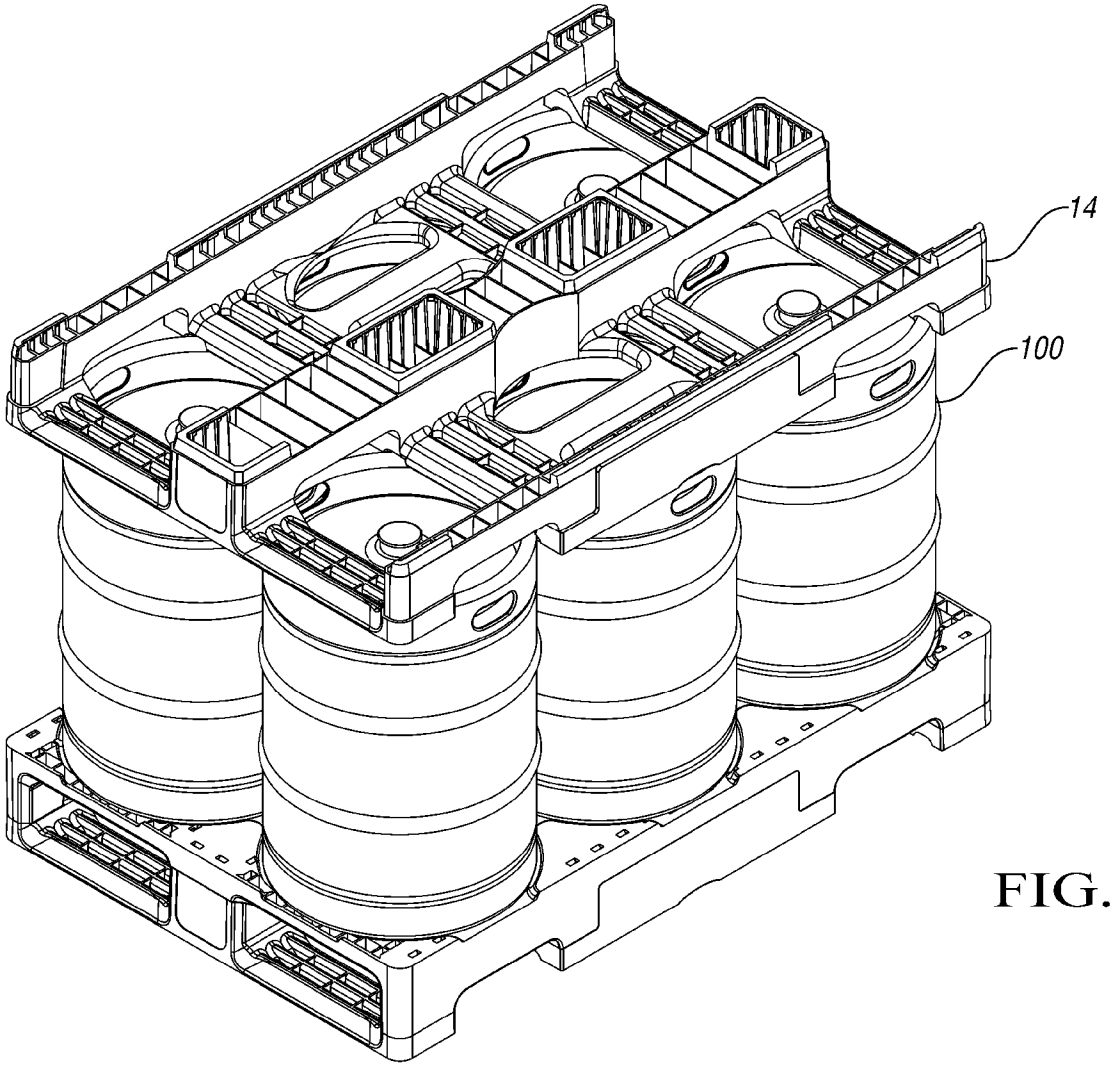
FIG. 14 is an upper perspective view of the pallets and kegs of FIG. 13.
Figure 15:
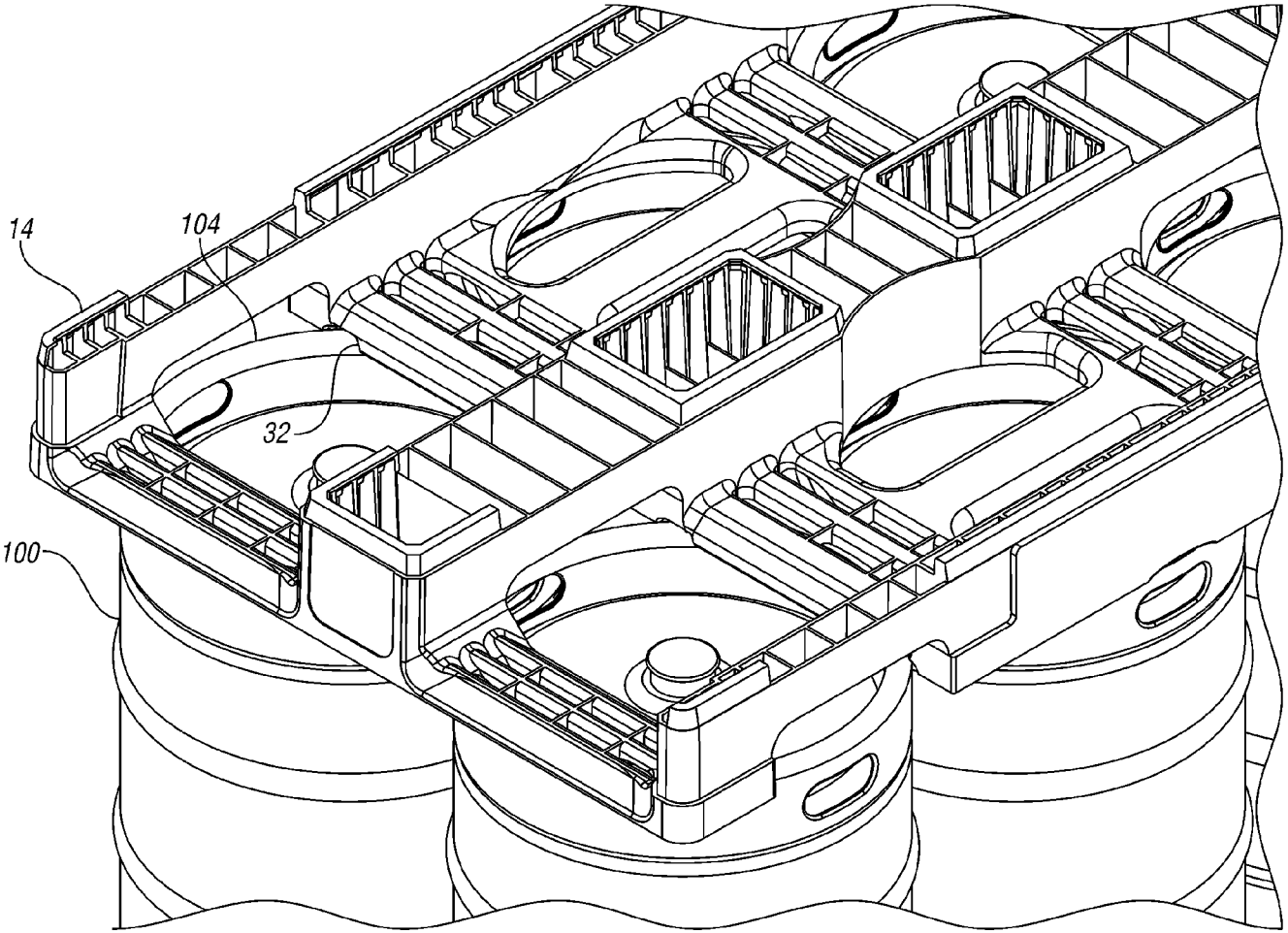
FIG. 15 is an enlarged view of an area of FIG. 14.

FIG. 14 shows the pallets 10 and kegs 100 of FIG. 12 with the upper structure 12 of the upper pallet removed for illustration. FIG. 15 is an enlarged view of a portion of FIG. 14, showing the upper cylindrical portion 104 of one of the kegs 100 received in the annular recess 32 in the bottom of the lower structure 14.

Figure 16:
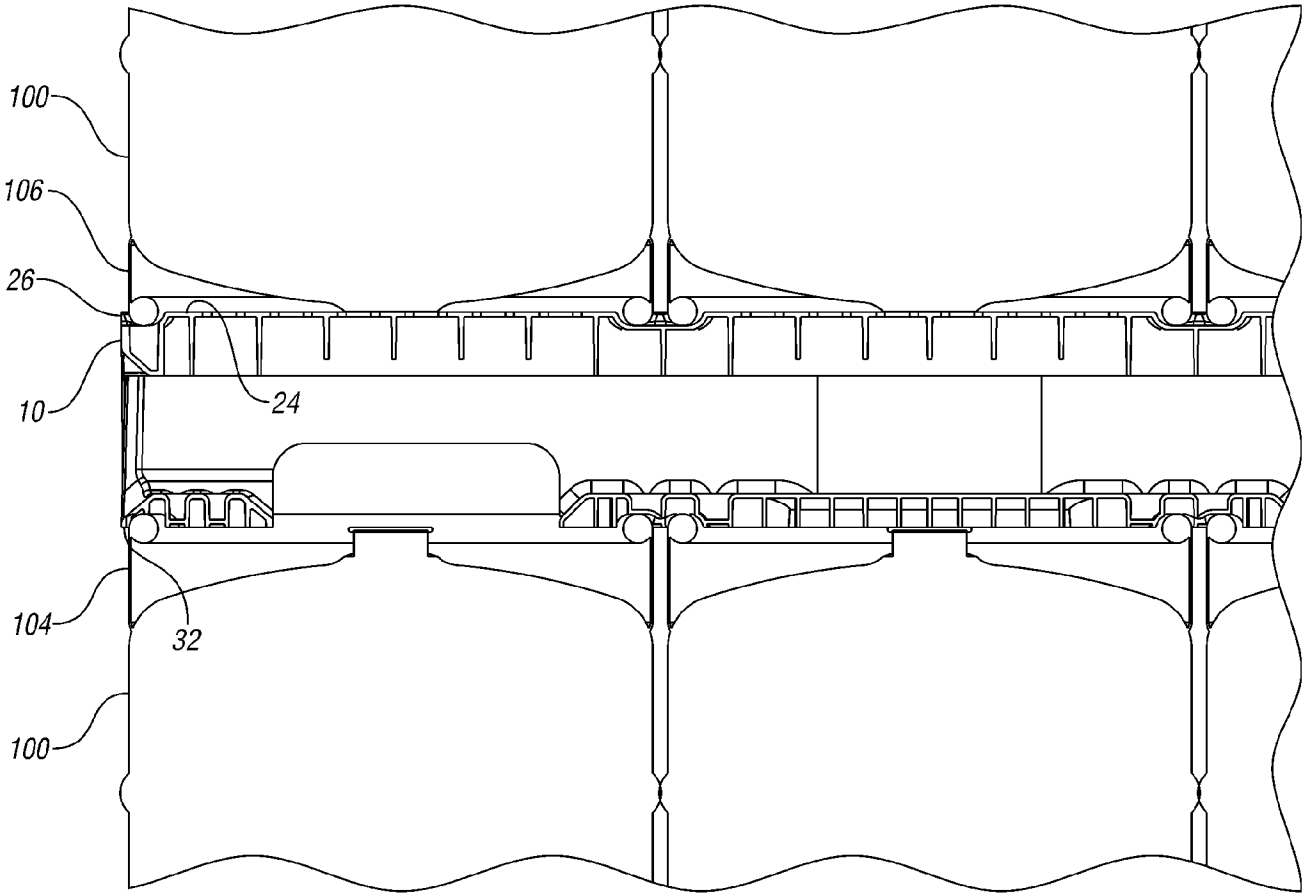
FIG. 16 is a section view through a portion of the pallet of FIG. 1, with a plurality of kegs stacked thereon and with the pallet stacked on a plurality of kegs.

FIG. 16 is a section view through the kegs 100 and one of the pallets 10 of FIG. 12. As shown, the base portion 106 of the keg 100 is received in the annular recess 26. The inner raised portion 24 is received within the diameter of the base portion 106. Further, the upper cylindrical portion 104 of each keg 100 is received within the annular recess 32 in the bottom of the pallet 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a lower structure including a stringer extending across the lower structure, the stringer including a corner column portion spaced away from central column portion to define a side opening below a bridge portion; and an upper structure including an upper deck and a sleeve portion extending downward from the upper deck, the upper structure connected to the lower structure with the sleeve portion forming double-walls structure with the corner column portion, the bridge portion and the central column portion.

2. The pallet of claim 1 wherein the sleeve portion at least partially covers the corner column portion, the bridge portion and the central column portion.

3. The pallet of claim 1 wherein the upper deck includes an upper surface with a plurality of inner raised portions each arranged to be received within a lower cylindrical end of a beer keg.

4. The pallet of claim 3 wherein the plurality of inner raised portions each include a continuous annular contact surface.

5. The pallet of claim 1 wherein the lower structure includes a plurality of ribs extending downward to free ends, a plurality of annular recesses formed in the free ends of the plurality of ribs.

6. The pallet of claim 1 wherein the stringer is one of a plurality of stringers in the lower structure, the lower structure further including first and second runners extending across the plurality of stringers, the pallet further including a beam extending from the first runner to the second runner in a direction generally parallel to the plurality of stringers.

7. The pallet of claim 1 wherein the sleeve portion of the upper structure covers at least a portion of a side face of the stringer continuously from one end of the stringer to the other end of the stringer.

8. The pallet of claim 1 wherein the stringer is a first outer stringer in the lower structure, the lower structure further including a second outer stringer and a central stringer between the outer stringers, wherein the central stringer is more than twice as wide as the outer stringers.

9. A pallet comprising:

a lower structure including a stringer extending across the lower structure, the stringer including a corner column portion spaced away from central column portion to define a side opening below a bridge portion; and an upper structure including an upper deck, the upper structure connected to the lower structure, the upper deck including an upper surface with a plurality of inner raised portions each arranged to be received within a lower cylindrical end of a beer keg, the plurality of inner raised portions each including a continuous annular contact surface, the plurality of inner raised portions each including a plurality of ribs extending downward therefrom.

10. The pallet of claim 9 wherein the lower structure includes a plurality of ribs extending downward to free ends, a plurality of annular recesses formed in the free ends of the plurality of ribs.

11. The pallet of claim 9 wherein the plurality of inner raised portions have a plurality of openings therethrough.

12. The pallet of claim 9 wherein the upper deck includes a plurality of outer raised portions spaced outward of the plurality of inner raised portions to define an annular recess around each of the plurality of inner raised portions, each annular recess sized to receive a base portion of a keg.

13. A pallet comprising:

an upper structure including an upper deck having an upper surface; and a lower structure including corner columns connected to the upper structure, the lower structure including a plurality of ribs extending downward to free ends, a plurality of annular recesses formed in the free ends of the plurality of ribs, wherein the annular recesses are defined about an axis generally perpendicular to the upper deck.

14. The pallet of claim 13 wherein the upper deck includes an upper surface with a plurality of inner raised portions each arranged to be received within a lower cylindrical end of a beer keg.

15. The pallet of claim 14 wherein the plurality of inner raised portions each include a continuous annular contact surface.

16. The pallet of claim 13 wherein the lower structure includes a stringer extending across the lower structure, the stringer including a corner column portion spaced away from central column portion to define a side opening below a bridge portion, the upper structure including a sleeve portion extending downward from the upper deck, the upper structure connected to the lower structure with the sleeve portion forming a double-wall structure with the corner column portion.

17. The pallet of claim 16 wherein the sleeve portion at least partially covers the corner column portion.

18. The pallet of claim 13 wherein the lower structure includes a plurality of stringers, the plurality of ribs formed in the plurality of stringers.

19. The pallet of claim 18 wherein the lower structure further includes first and second runners extending across the plurality of stringers, the pallet further including a beam extending from the first runner to the second runner in a direction generally parallel to the plurality of stringers.

20. The pallet of claim 19 wherein the plurality of stringers includes a first outer stringer, a second outer stringer and a central stringer between the outer stringers, wherein the central stringer is more than twice as wide as the outer stringers.

21. The pallet of claim 13 wherein each of the free ends has a recess formed therein and the recesses in the free ends together form the annular recesses.

22. A pallet comprising:

an upper structure including an upper deck, the upper deck including an upper surface with a plurality of inner raised portions each arranged to be received within a lower cylindrical end of a beer keg; and a lower structure including corner columns connected to the upper structure, the lower structure including a plurality of ribs extending downward to free ends, a plurality of recesses formed in the free ends of the plurality of ribs, the recesses in the free ends together forming an annular recess.

* * * * *